US010464649B1

(12) United States Patent
Wood

(10) Patent No.: US 10,464,649 B1
(45) Date of Patent: Nov. 5, 2019

(54) MANUAL JACK PLATE

(71) Applicant: John Martin Wood, Tallahassee, FL (US)

(72) Inventor: John Martin Wood, Tallahassee, FL (US)

( * ) Notice: Subject to any disclaimer, the term of this patent is extended or adjusted under 35 U.S.C. 154(b) by 0 days.

(21) Appl. No.: 16/044,997

(22) Filed: Jul. 25, 2018

(51) Int. Cl.

| | |
|---|---|
| ***B63H 5/125*** | (2006.01) |
| ***B63H 20/08*** | (2006.01) |
| ***B63H 20/10*** | (2006.01) |
| ***B63H 20/06*** | (2006.01) |

(52) U.S. Cl.
CPC ..... *B63H 20/106* (2013.01); *B63H 20/06* (2013.01)

(58) Field of Classification Search
CPC ..... B63H 20/02; B63H 20/06; B63H 20/08; B63H 20/10; B63H 20/106; B63H 2020/02; B63H 2020/08; B63H 2020/10; B63H 2020/103
USPC ..... 440/53, 54, 58, 61 T, 61 E, 61 F, 62, 63, 440/64
See application file for complete search history.

(56) References Cited

U.S. PATENT DOCUMENTS

| | | | | |
|---|---|---|---|---|
| 2,928,630 A * | 3/1960 | Wisman | B63H 20/106 248/207 |
| 2,928,631 A * | 3/1960 | Hartman | B63H 20/106 248/641 |
| 3,242,899 A * | 3/1966 | Hanson | B63H 20/106 248/641 |
| 5,944,568 A * | 8/1999 | Rabal | B63H 20/106 440/53 |
| 5,964,627 A * | 10/1999 | Detwiler | B63H 20/106 440/58 |
| 6,305,996 B1 * | 10/2001 | Detwiler | B63H 20/106 248/641 |
| 6,652,335 B1 * | 11/2003 | Peschmann | B63H 20/06 248/642 |
| 7,731,552 B1 * | 6/2010 | Pelini | B63H 20/06 440/53 |
| 10,150,547 B1 * | 12/2018 | Pelini | B63H 20/106 |

* cited by examiner

*Primary Examiner* — Daniel V Venne
(74) *Attorney, Agent, or Firm* — J. Wiley Horton

(57) ABSTRACT

A vertically adjustable jack plate configured to attach an outboard motor (or analogous device) to the transom of a marine vessel. A transom bracket is provided for connection to the vessel. A motor mounting plate is connected to the transom bracket. A lift jack vertically adjusts the position of the motor mounting plate with respect to the transom bracket. The lift jack incorporates a drive shaft that is used to vary an amount of extension or the lift jack. A handle is provided on the drive shaft. In operation, the user must preferably engage the handle to the drive shaft in order to turn the drive shaft. In a preferred embodiment the user must push the handle inward toward the lift jack in order to engage the handle to the drive shaft.

18 Claims, 6 Drawing Sheets

MANUAL JACK PLATE

BACKGROUND OF THE INVENTION

1. Field of the Invention

This invention relates to the field of marine vessels. More specifically, the invention comprises a manual jack plate configured to vary the height of an outboard motor or similar device with respect to a vessel transom.

2. Description of the Related Art

Outboard motors, trolling motors, and other accessories are frequently mounted to the transom of a marine vessel. As an example, outboard motors customarily include a pair of mounting clamps that slip over an upper lip of a transom and secure the motor in place. Many outboard motors include a tilting mechanism that pivots the entire motor about a horizontal axis. This titling mechanism is used to adjust the depth of the motor's propeller in the water. Tilting the motor raises the propeller and allows the vessel to travel in more shallow water.

Unfortunately, tilting the motor also inclines the propeller's rotation axis and produces an increasing downward component of the forward thrust. This downward component tends to reduce the efficiency of the outboard motor, as well as reducing its ability to steer the vessel. The use of a "jack plate" is a well known solution to these recognized problems. A jack plate is attached to the transom. It provides a vertical offset for the mounting of the outboard motor. Some jack plates are fixed, while others are adjustable. They are generally used to provide a desired amount of vertical offset for an outboard motor.

BRIEF SUMMARY OF THE PRESENT INVENTION

The present invention comprises a vertically adjustable jack plate configured to attach an outboard motor (or analogous device) to the transom of a marine vessel. A transom bracket is provided for connection to the vessel. A motor mounting plate is connected to the transom bracket. A lift jack vertically adjusts the position of the motor mounting plate with respect to the transom bracket. The lift jack incorporates a drive shaft that is used to vary an amount of extension of the lift jack. A handle is provided on the drive shaft. In operation, the user must preferably engage the handle to the drive shaft in order to turn the drive shaft. In a preferred embodiment the user must push the handle inward toward the lift jack in order to engage the handle to the drive shaft.

REFERENCE NUMERALS IN THE DRAWINGS

Figure 1:
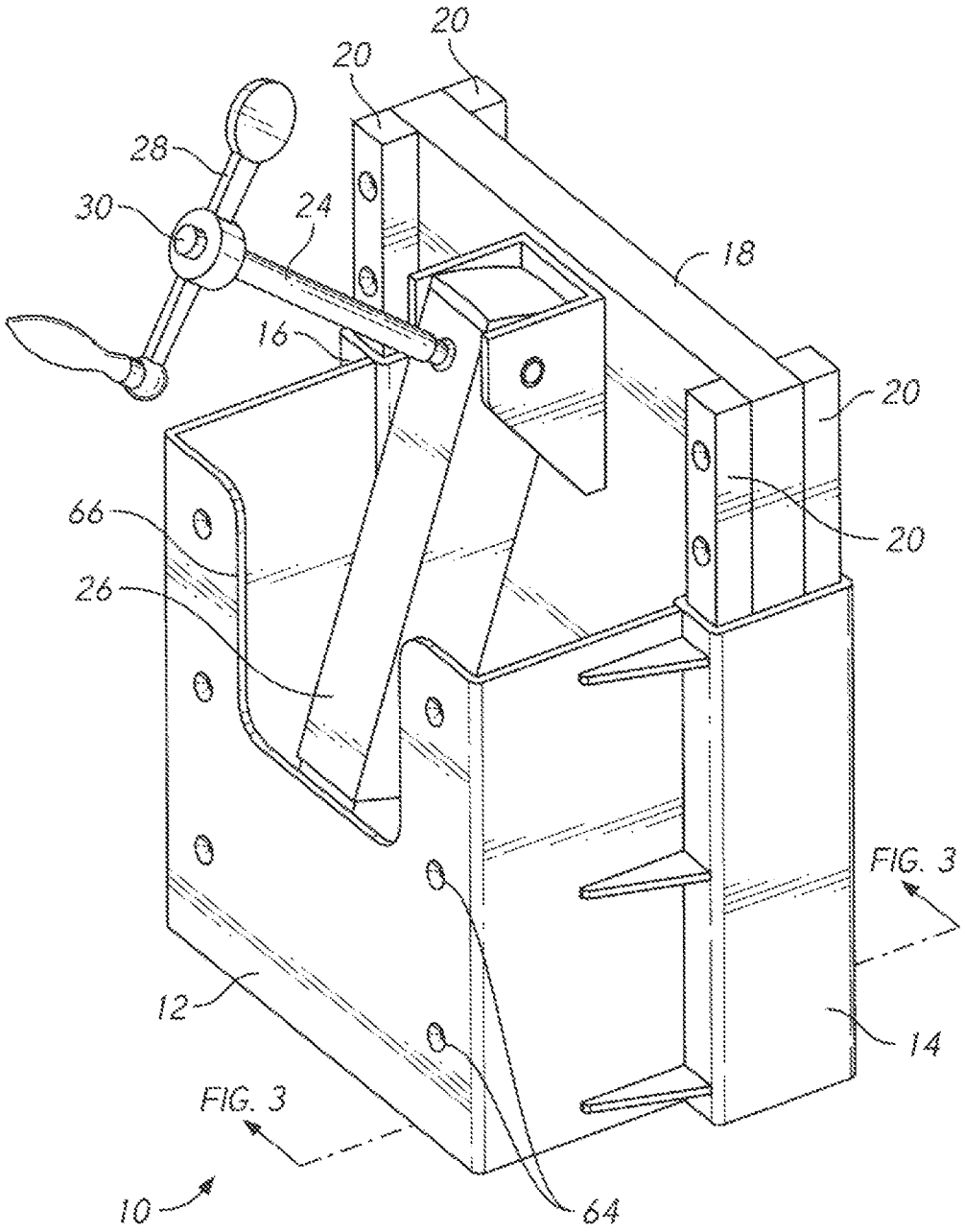
FIG. 1 is a perspective view, showing an embodiment of the proposed invention.

10 jack plate assembly
12 transom bracket
14 left receiver
16 right receiver
18 motor mounting plate
20 slide rail
22 upper bracket
24 drive shaft
26 lift jack
28 handle
30 hub
32 transom
34 clamp
36 outboard motor
38 upper pin joint
40 lower bracket
42 lower pin joint
44 extension leg
46 chassis
48 upper through hole
50 lower through hole
52 retaining ring
54 gear
56 gear
58 key
60 drive disk
62 spring
64 mounting hole
66 relief
68 removable pin
70 removable pin

DETAILED DESCRIPTION OF THE INVENTION

The present invention can be physically realized in a wide variety of ways. FIGS. 1-5 illustrate exemplary embodiments of the invention. The reader should bear in mind that the invention is not limited to any particular embodiment.

FIG. 1 shows a completed example of the invention labeled as jack plate assembly 10. Transom bracket 12 is configured to mount to the transom—such as by passing mounting bolts through mounting holes 64. Motor mounting plate 18 is slidably attached to transom bracket 12 so that it may be moved up and down as desired. This sliding attachment may be made using a variety of different components.

In the example shown in FIG. 1, left receiver 14 and right receiver 16 are provided. Four slide rails 20 are attached to the left and right lateral sides of motor mounting plate 18. The actual method of attachment is not particularly important. One suitable approach is the use of cap screws passing through a counterbored hole and into the motor mounting plate.

The slide rails are preferably made of a slick material such as NYLON (semi-aromatic polyamide) or DELRIN (polyoxymethylene). The addition of slide rails 20 gives the motor mounting plate an "I" cross section, with each end plate of the "I" cross section sliding up and down within a rectangular receiver 14, 16.

The elevation of motor mounting plate 18 is regulated by the extension of lift jack 26. Lift jack 26 is attached at its lower end to transom bracket 12 and at its upper end to upper bracket 22 on motor mounting plate 18. Drive shaft 24 turns in order to adjust the extension of lift jack 26. Handle 28 is provided to facilitate the grasping and turning of the drive shaft. Handle 28 is linked to drive shaft 24 by hub 30. In order to raise motor mounting plate 18 the user engages the handle and turns drive shaft 24 in a first direction (such as clockwise). In order to lower the motor mounting plate the user engages the handle and rotates the drive shaft in the opposite direction.

Relief 66 is provided in the forward portion of transom bracket 12. A comparable relief is provided in the aft portion (not visible in FIG. 1). The relief in the aft portion provides clearance for the outboard mounting clamps.

Figure 2:
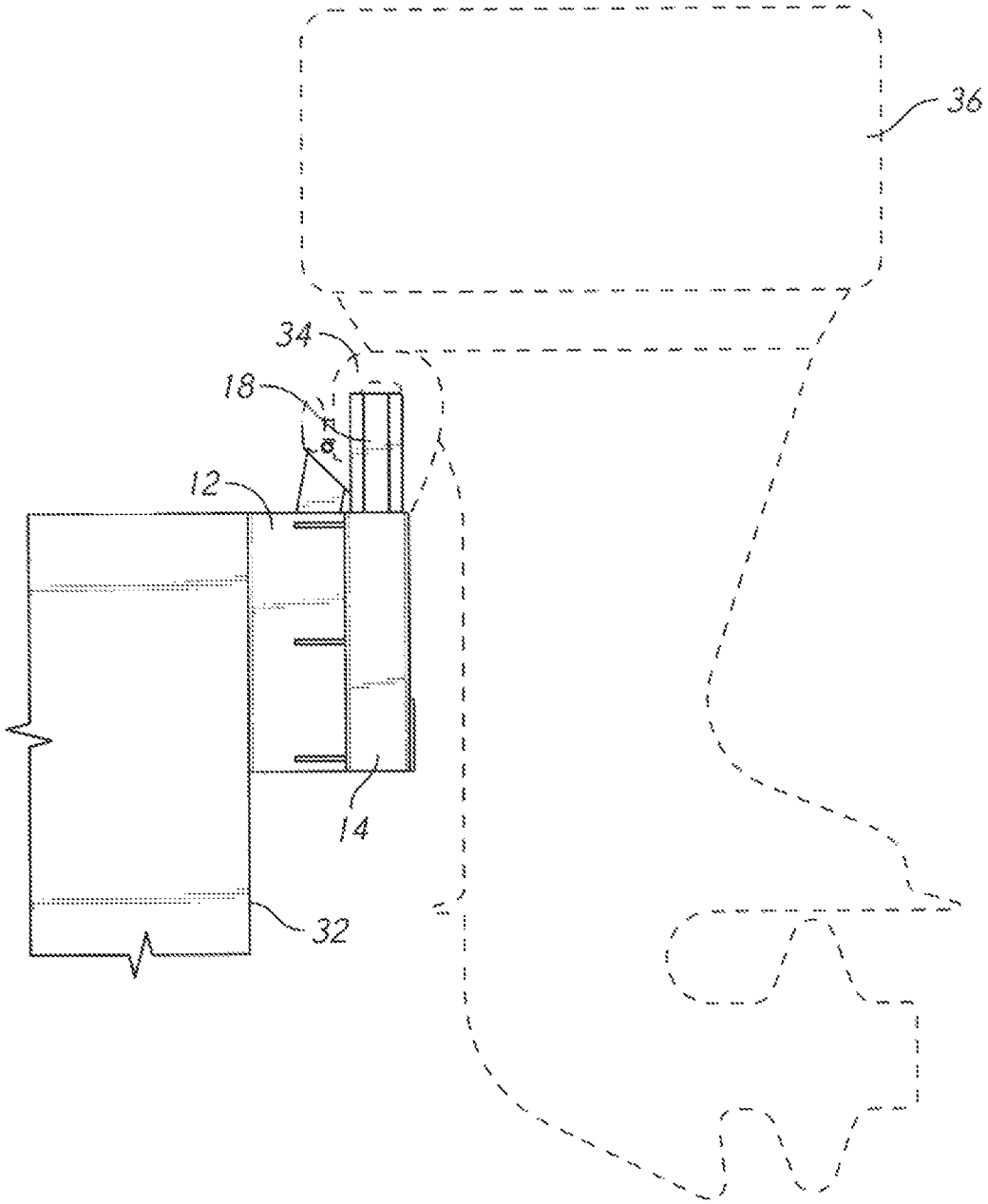
FIG. 2 is an elevation view, showing the proposed invention attached to a transom.

FIG. 2 depicts an elevation view of an exemplary installation of the present invention. Outboard 36 is attached to motor mounting plate 18 using a pair of clamps 34 that are integral to the outboard itself. These clamps are conventional in design and well known to those knowledgeable in the field. In this view the reader will observe that transom bracket 12 is attached to transom 32. The particular transom shown is vertical. Some transoms may tilt rearward so that the upper portion of the transom is further aft than the lower portion. The invention will work irrespective of the transom angle.

Outboard 36 is fixedly attached to motor mounting plate 18. When the user raises and lowers the motor mounting plate, the outboard motor will move with it.

Figure 3:
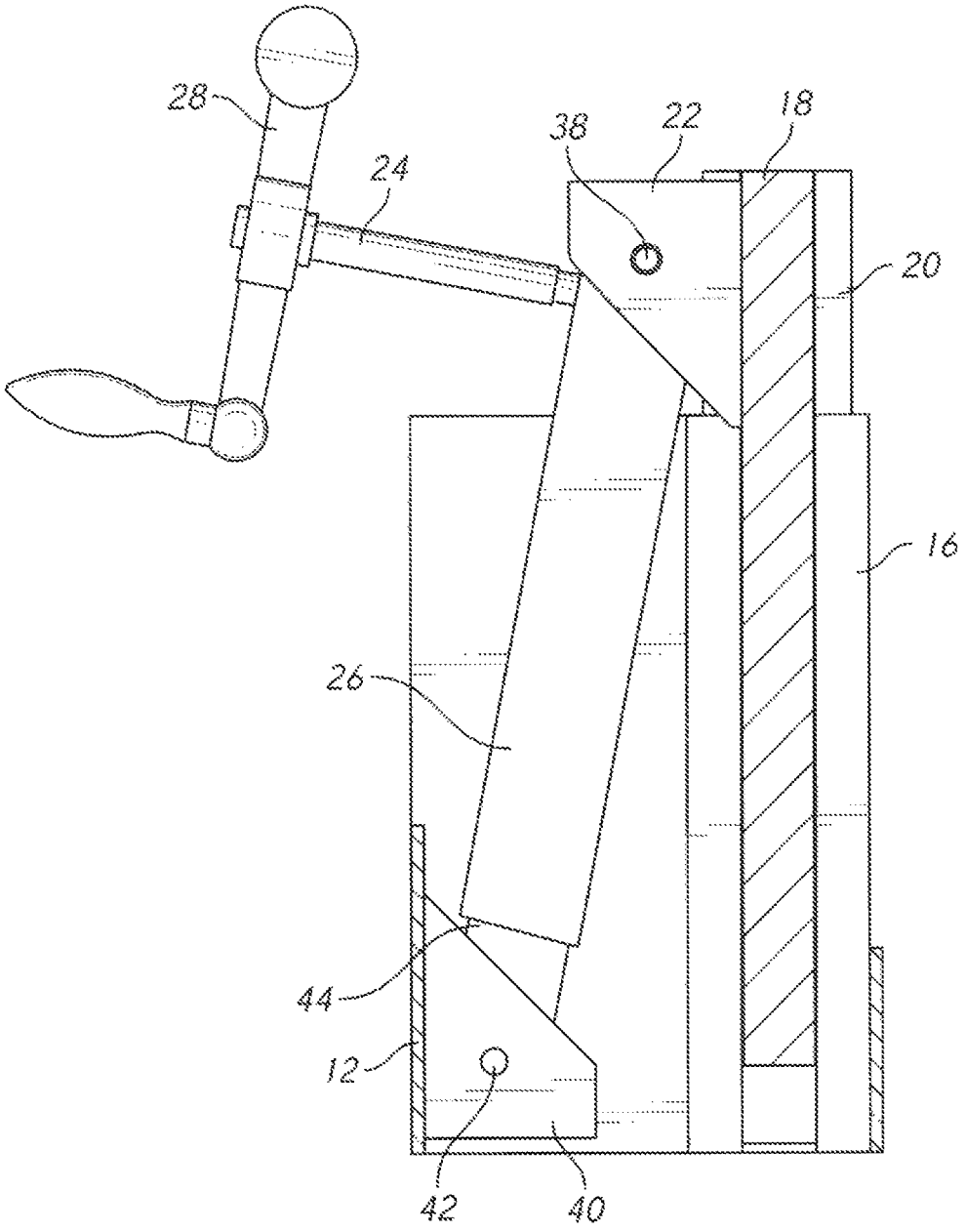
FIG. 3 is a sectional elevation view, showing some internal details of the proposed invention.

Returning briefly to FIG. 1, the reader will observe the location of the "callouts" for the section view depicted in FIG. 3. In FIG. 3 the reader may readily observe how lift jack 26 defines the positional relationship between motor mounting plate 18 and transom bracket 12. Extension leg 44 of lift jack 26 is extended and retracted by turning drive shaft 24. The upper portion of the lift jack is pivotally connected to upper bracket 22 by upper pin joint 38 (Upper bracket 22 is attached to motor mounting plate 18, such as by a welded joint). The lower portion of extension leg 44 is pivotally connected to lower bracket 40 by lower pivot pin 42. The lower bracket is attached to transom bracket 12 (such as by another welded joint).

Figure 4:
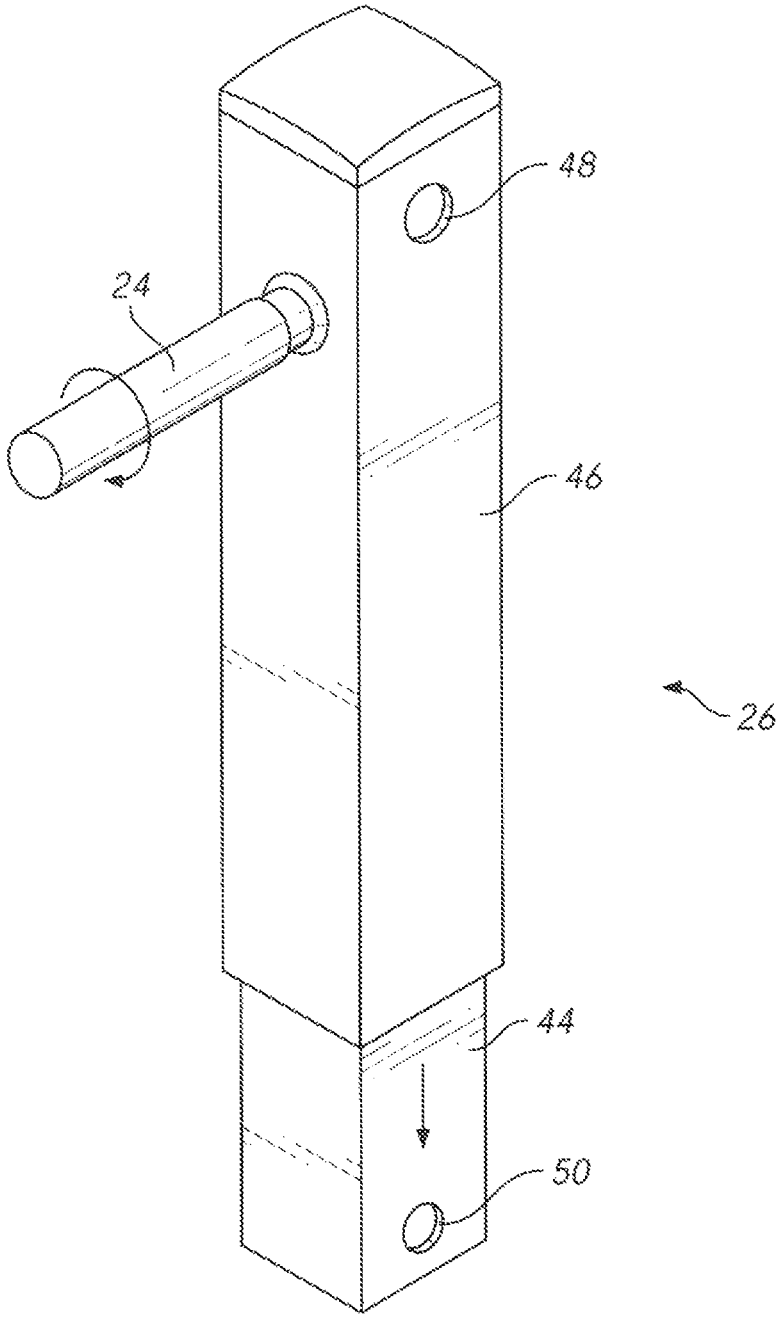
FIG. 4 is a perspective view, showing an exemplary lift jack that can be employed in the present invention.

FIG. 4 depicts lift jack 26 in more detail. The type shown is customarily mounted on the tongue of a trailer and is used to lift the tongue to a proper height for hitching the trailer to a tow ball. Many different lift jacks could be employed in the present invention and the invention is by no means limited to any particular type. For the type shown, rotating drive shaft 24 in a clockwise direction causes extension leg 44 to extend as indicated by the arrow. Rotating the drive shaft in a counterclockwise direction causes the extension leg to retract.

Upper through hole 48 in chassis 46 allows a transverse pin to be passed through the device in order to provide an external connection. Lower through hole 50 in extension leg 44 likewise allows a transverse pin to be passed through. The internal working details of the lift jack are beyond the scope of this disclosure. Generally, such devices include a bevel gear attached to drive shaft 24. This first bevel gear rotates a second bevel gear attached to a vertical shaft. The vertical shaft drives a jack screw that propels extension leg 44 in and out of chassis 46. An exemplary type is the Curt model 28575 made by Curt Manufacturing of Eau Claire, Wis.

Many turns of drive shaft 24 are required to extend extension leg 44 fully. Such devices do not need any type of latch to hold them in position. When the handle is released the amount of extension will remain fixed, even if a large compressive load is placed on the lift jack (A large compressive load will not tend to turn the drive shaft in reverse because the reduction gear ratio is tee great). However, once a desired position for the motor mounting plate is reached, it may well be desirable to disconnect the handle from the drive shaft so that inadvertent motion is inhibited.

Returning to FIG. 1, the reader will recall that handle 28 is connected to drive shaft 24 via hub 30. In the example shown, the connection between the handle and the drive shaft is selective. In other words, the handle can be disconnected from the drive shaft so that the handle can turn freely without engaging the drive shaft.

Figure 5:
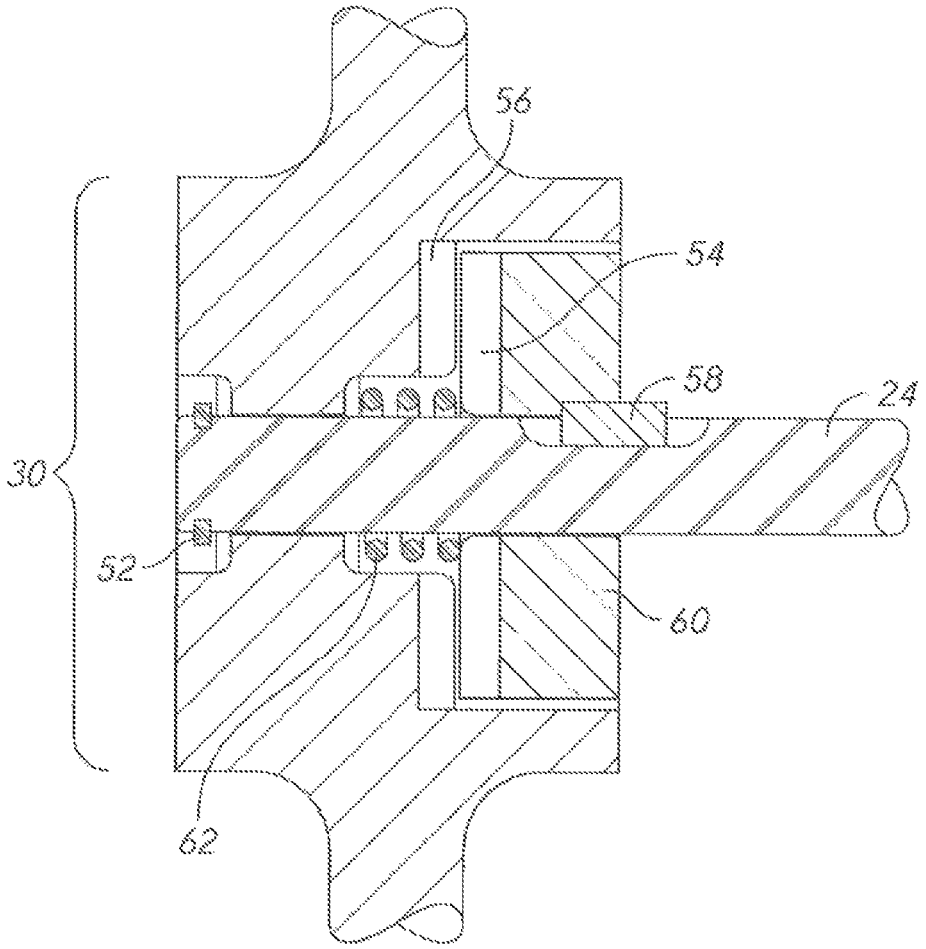
FIG. 5 is a sectional view, showing an embodiment of a selective drive mechanism that can be used in the crank handle of the present invention.

There are many ways to create a selective engagement between the handle and the drive shaft. FIG. 5 depicts one mechanism for creating this selective engagement. The section depicted in FIG. 5 is taken through the center of drive shaft 24. Drive disk 60 is a circular disk that is locked to drive shaft 24, such as by the insertion of key 38 in a conventional fashion. A simple press fit may also be used. Whatever method is employed, drive disk 60 rotates in unison with drive shaft 24.

In the orientation shown in FIG. 5, the lift jack itself is off to the right. Drive disk 60 includes a face gear 54 on its outward facing side. Hub 30 is a close sliding fit over the portion of drive shaft 24 that extends outward beyond drive disk 60. Retaining ring 52 is clipped in place on the outer extreme of the drive shaft so that the hub cannot slide free of the drive shaft without first removing the retaining ring. Compression spring 62 urges hub 30 to the left in the orientation shown in the view.

Hub 30 includes a face gear 56 on its inward facing side, with gear 56 being configured to selectively mesh with gear 54 on drive disk 60. From this description those skilled in the art will understand that when a user presses the handle (and consequently hub 30) inward toward the lift jack gear 56 will mesh with gear 54 and hub 30 will then transmit torque to drive disk 60. The user is thereby able to turn drive shaft 24 in either direction. However, if the user does not press the handle inward toward the lift jack, then spring 62 will urge the mating gears 54, 56 apart and the handle will "free-wheel." Turning the handle in that case will not turn the drive shaft.

The use of the mating face gears 54, 56 is one of many different ways to selectively engage hub 30 and drive disk 60. The face gears act in this instance as a dog clutch and—as those skilled in the art will know—there are many different types of dog clutch mechanism. Any could be substituted.

The invention is not limited to any particular materials, but a discussion of material selection and fabrication techniques may benefit the reader's understanding. Some of these considerations will be discussed with reference to FIG. 1. Transom bracket 12 may be fabricated as an aluminum weldment. Left and right receivers 14, 16 may be made of rectangular aluminum C-channel. These C-channels may be seam welded to transom bracket 12. Triangular gussets may then be welding in place to stiffen the assembly (as shown). The upper and lower brackets 22, 42 may be welded in position or bolted in position.

The lift jack is preferably one designed to operate in a marine environment. Such units are often made of stainless steel, galvanized steel, or powder-coated steel. Some units feature an aluminum chassis and extension leg, though the shafts and gears are customarily steel for these units.

The handle and drive disk may be stainless steel. Alternatively, a caustic bluing process may be applied to these components to provide corrosion resistance. It is also preferable to provide grease fittings so that the internal lubrication of the hub and lift jack components can be periodically renewed.

FIG. 1 shows jack plate assembly detached from the vessel and with no outboard motor attached. However, from this view the reader will understand that the handle remains accessible above the transom when the unit is attached. The reader will also understand that space is provided for the outboard motor clamps on either side of upper bracket 22. Once the unit is in place on a vessel the user can raise the outboard motor by pushing in the handle and turning it in the correct direction (such as clockwise). The user can lower the outboard motor by pushing in the handle and turning it in the opposite direction. The height setting thus achieved will remain fixed until the user decides to change it by pushing in the handle and turning it again.

Figure 6:
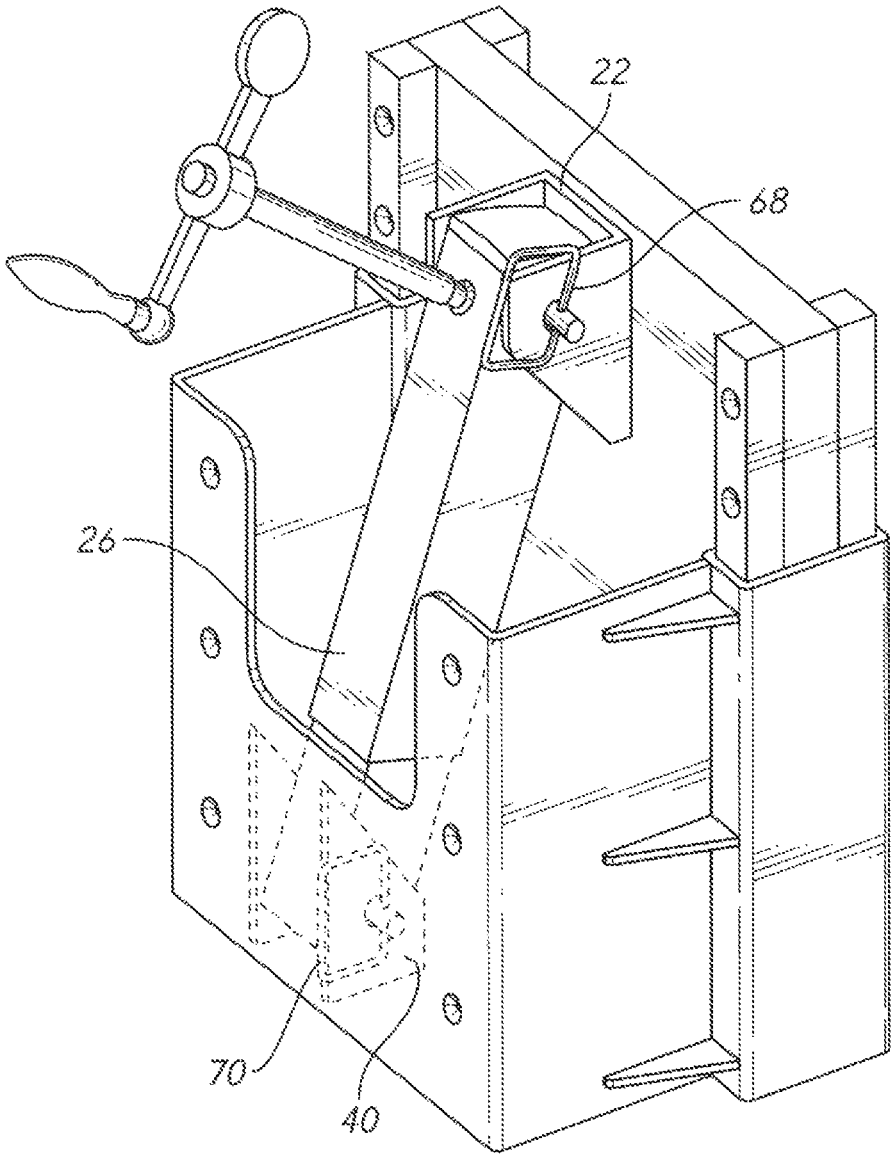
FIG. 6 is a perspective view, showing the use of removable pins to hold the lift jack in place.

It is advantageous to provide for the quick disassembly of the unit shown in FIG. 1. This allows the parts to be separated for cleaning and maintenance. In addition, it allows for the rapid replacement of a defective part. FIG. 6 shows an embodiment configured for rapid disassembly. In this example, lift jack 26 is secured in position by removable pins 68, 70. Removable pin 68 passes through upper bracket 22 and removable pin 70 passes through lower bracket 40. In order to remove lift jack 26 from the assembly, the user grasps and slides out the two removable pins.

In the example shown, each removable pin has a folding ring that must be rotated outward in order to remove the pin. This feature has the added benefit of preventing the unwanted removal of the removable pins. Many other types could be used and the invention is not limited to any particular type.

Although the preceding description contains significant detail, it should not be construed as limiting the scope of the invention but rather as providing illustrations of the preferred embodiments of the invention. One skilled in the art may easily devise variations on the embodiments described. Thus, the scope of the invention should be fixed by the claims rather than the examples given.

Having described my invention, I claim:

1. A jack plate assembly for allowing a user to selectively adjust a height of an outboard motor relative to a transom, comprising:

(a) a transom bracket configured for attachment to said transom;
(b) a motor mounting plate, slidably connected to said transom bracket, with said motor mounting plate being configured to connect to said outboard motor;
(c) a lift jack, having an upper end, a lower end, and a drive shaft;
(d) wherein a rotation of said drive shaft changes a distance between said upper end and said lower end of said lift jack;
(e) said lower end of said lift jack being connected to said transom bracket;
(f) said upper end of said lift jack being connected to said motor mounting plate;
(g) a handle configured to engage and turn said drive shaft;
(h) said motor mounting plate having a left side and a right side;
(i) said left side of said motor mounting plate including a slide rail; and
(j) said right side of said motor mounting plate including a second slide rail.

2. The jack plate assembly as recited in claim 1, wherein said handle is configured to selectively engage said drive shaft.

3. The jack plate assembly as recited in claim 1, further comprising:

(a) an upper bracket connected to said motor mounting plate;
(b) a lower bracket connected to said transom bracket;
(c) said lower end of said lift jack is pivotally connected to said lower bracket; and
(d) said upper end of said lift jack is pivotally connected to said upper bracket.

4. The jack plate assembly as recited in claim 1, further comprising:

(a) a left receiver;
(b) a right receiver; and
(c) wherein a left side of said motor mounting plate slides up and down within said left receiver and a right side of said motor mounting plate slides up and down within said right receiver.

5. The jack plate assembly as recited in claim 2, wherein said handle is configured to engage said drive shaft when said user pushes said handle toward said lift jack.

6. The jack plate assembly as recited in claim 5, comprising:

(a) a drive disk connected to said drive shaft and leaving an outer exposed end of said drive shaft;
(b) wherein said handle includes a hub slidably mounted on said outer exposed end of said drive shaft;
(c) a spring configured to urge said handle away from said drive disk; and
(d) a gear engagement between said hub and said drive disk, configured to rotatably lock said hub to said drive disk when said user presses said hub inward against said drive disk.

7. The jack plate assembly as recited in claim 6, wherein said gear engagement comprises:

(a) an outward facing face gear on said drive disk; and
(b) an inward facing face gear on said hub.

8. The jack plate assembly as recited in claim 1, wherein said lift jack includes a chassis and an extension leg.

9. The jack plate assembly as recited in claim 3, wherein:

(a) said pivotal connection between said lower end of said lift jack and said lower bracket comprises a first removable pin; and
(b) said pivotal connection between said upper end of said lift jack and said upper bracket comprises a second removable pin.

10. A jack plate assembly for allowing a user to selectively adjust a height of an outboard motor relative to a transom, comprising:

(a) a transom bracket configured for attachment to said transom;
(b) a motor mounting plate connected to said transom bracket, with said connection allowing said motor mounting plate to translate vertically with respect to said transom bracket;
(c) a lift jack, having a chassis, an extension leg, and a drive shaft;
(d) wherein a rotation of said drive shaft changes an amount of extension of said extension leg from said chassis;
(e) said extension leg of said lift jack being connected to said transom bracket;
(f) said chassis of said lift jack being connected to said motor mounting plate; and (g) a handle configured to engage and turn said drive shaft.

11. The jack plate assembly as recited in claim 10, wherein said handle is configured to selectively engage said drive shaft.

12. The jack plate assembly as recited in claim 10, further comprising:

(a) an upper bracket connected to said motor mounting plate;

(b) a lower bracket connected to said transom bracket;

(c) said extension leg of said lift jack is pivotally connected to said lower bracket; and (d) said chassis of said lift jack is pivotally connected to said upper bracket.

13. The jack plate assembly as recited in claim 10, further comprising:

(a) a left receiver;

(b) a right receiver; and (c) wherein a left side of said motor mounting plate slides up and down within said left receiver and a right side of said motor mounting plate slides up and down within said right receiver.

14. The jack plate assembly as recited in claim 13, wherein:

(a) said left side of said motor mounting plate includes a first pair of slide rails; and (b) said right side of said motor mounting plate includes a second pair of slide rails.

15. The jack plate assembly as recited in claim 11, wherein said handle is configured to engage said drive shaft when said user pushes said handle toward said lift jack.

16. The jack plate assembly as recited in claim 15, comprising:

(a) a drive disk connected to said drive shaft and leaving an outer exposed end of said drive shaft;

(b) wherein said handle includes a hub slidably mounted on said outer exposed end of said drive shaft;

(c) a spring configured to urge said handle away from said drive disk; and (d) a gear engagement between said hub and said drive disk, configured to rotatably lock said hub to said drive disk when said user presses said hub inward against said drive disk.

17. The jack plate assembly as recited in claim 16, wherein said gear engagement comprises:

(a) an outward facing gear on said drive disk; and (b) an inward facing face gear on said hub.

18. The jack plate assembly as recited in claim 12, wherein:

(a) said pivotal connection between said extension leg and said lower bracket comprises a first removable pin; and (b) said pivotal connection between said chassis of said lift jack and said upper bracket comprises a second removable pin.

* * * * *